US005385264A

United States Patent [19]

Kaufman et al.

[11] Patent Number: 5,385,264

[45] Date of Patent: Jan. 31, 1995

[54] BEVERAGE CONTAINER

[75] Inventors: Richard H. Kaufman, Chappaqua; Theodore J. Kovacic, Bedford, both of N.Y.; Hideyoshi Okita, Huntington Beach, Calif.; Martin M. Bostwick, Norwalk, Conn.; Andrew T. Kostanecki, Darien, Conn.; Robert H. Brainard, Danbury, Conn.; Patrick B. Nolan, Norwalk, Conn.

[73] Assignee: Kraft General Foods, Inc., Northfield, Ill.

[21] Appl. No.: 898,114

[22] Filed: Jun. 12, 1992

Related U.S. Application Data

[63] Continuation-in-part of Ser. No. 776,444, Oct. 17, 1991, abandoned.

[51] Int. Cl.[6] ..... B65D 25/46

[52] U.S. Cl. ..... 220/710; 215/1 A; 229/75

[58] Field of Search ..... 220/705, 709, 710; 215/1 A, 229, 253; 229/75

[56] References Cited

U.S. PATENT DOCUMENTS

| | | | |
|---|---|---|---|
| 2,516,728 | 7/1950 | Smith | 222/108 |
| 3,303,984 | 2/1967 | Jurena | 229/7 |
| 3,332,567 | 7/1967 | Pugh, Sr. | 215/100 |
| 3,347,401 | 10/1967 | Nataf | 215/1 |
| 3,462,061 | 8/1969 | Shore | 229/7 |
| 3,486,679 | 12/1969 | Pfahler | 229/7 |
| 4,301,926 | 11/1981 | Chung | 206/620 |
| 4,573,631 | 3/1986 | Reeves | 229/7 |
| 4,607,755 | 8/1986 | Andreozzi | 215/1 A |
| 4,669,608 | 6/1987 | Thompson | 206/217 |
| 4,712,702 | 12/1987 | Ayabe et al. | 220/90.2 |
| 4,830,204 | 5/1989 | Lin | 215/1 A |
| 4,982,854 | 1/1991 | Ichimiya | 215/1 A |
| 5,005,717 | 4/1991 | Oilar | 215/13.1 |
| 5,054,631 | 10/1991 | Robbins, III | 215/1 A |
| 5,078,286 | 1/1992 | Hashimoto | 215/1 A |

FOREIGN PATENT DOCUMENTS

| | | | |
|---|---|---|---|
| 2492769 | 4/1982 | France . | |
| 59-172168 | 11/1984 | Japan . | |
| 61-681553 | 6/1986 | Japan . | |
| 63-79337 | 5/1988 | Japan . | |
| 2-117334 | 9/1990 | Japan . | |
| 978901 | 1/1965 | United Kingdom | 229/130.1 |
| WO8504850 | of 1985 | WIPO . | |

*Primary Examiner*—Joseph Man-Fu Moy
*Attorney, Agent, or Firm*—Thomas R. Savoie; Thomas A. Marcoux

[57] ABSTRACT

A unitary beverage container includes a main body defining a container volume. A flexible straw is fluidly connected at a proximal end with the volume adjacent the bottom of the main body. The flexible straw includes a series of segments which provide bending diaphragms. The straw also includes a distal end which is preferably in the form of a planar hollow mouthpiece having vertical wings and a central aperture therein with the mouthpiece is located adjacent the top of the main body. The segments of the straw near the bottom are strengthened and a curved portion of the straw has wedge shaped segments. An attaching mechanism removably attaches the distal end of the flexible straw to the top of main body and closes the aperture of the distal end. The attaching mechanism includes a short hollow bridge extending from the aperture at the distal end of the flexible straw which is broken during removal of the flexible straw to uncover the aperture prior to use. The hollow bridge is connected to a hollow chamber which is otherwise isolated fluidly from the container volume. A concavity in which the mouthpiece is received is provided at the top. A second attaching mechanism removably attaches the flexible straw to the main body.

15 Claims, 6 Drawing Sheets

32
26
34
16
20
21
10
12
18
24
22

16
32
34
21
20a
44
10
12
18

20a
32
34
42
36
16
21
20
10
26
8
45
44
12
8
22
24
18

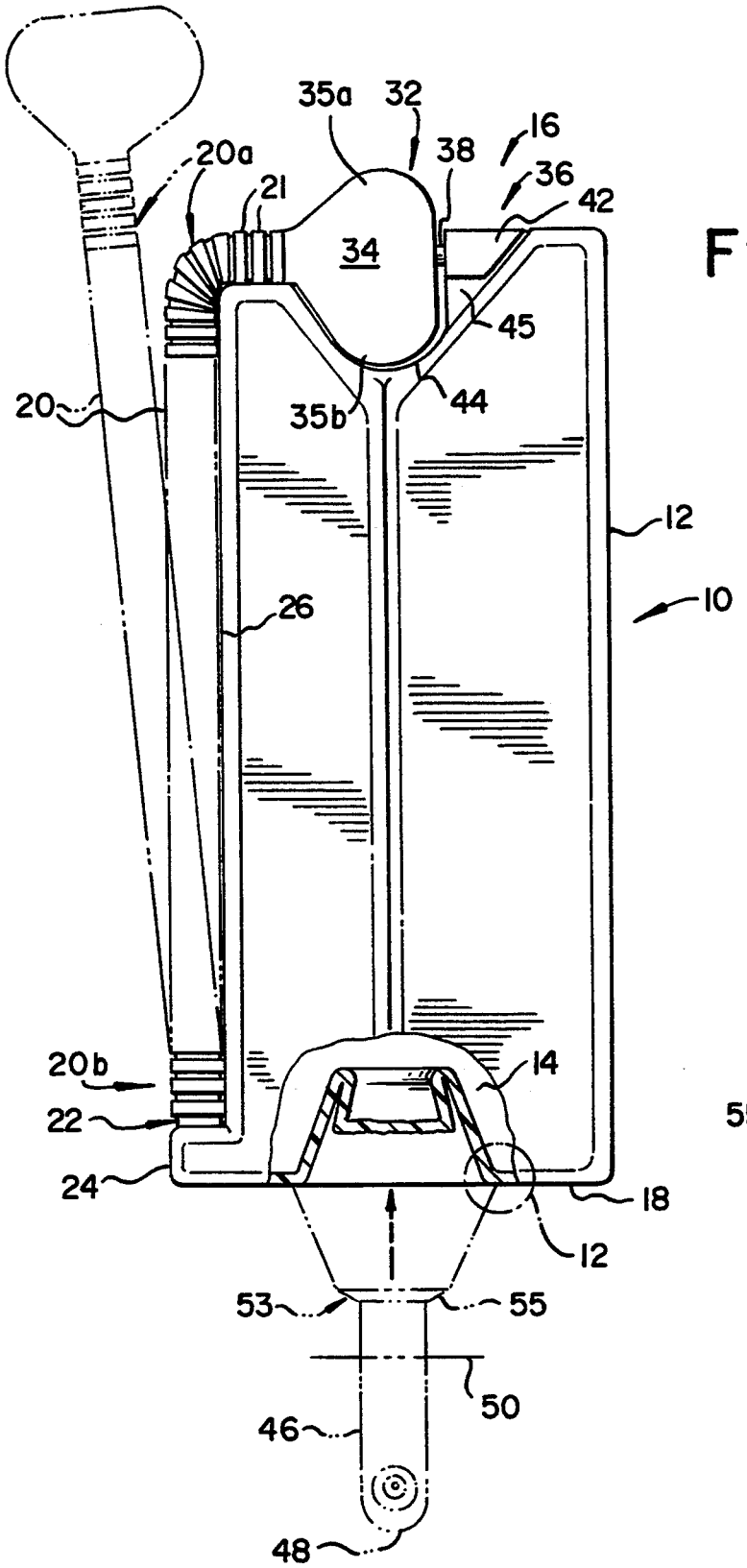
Fig. 4
Fig. 5
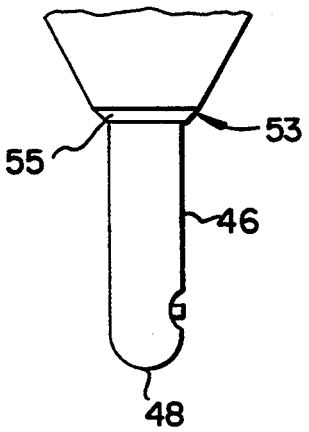

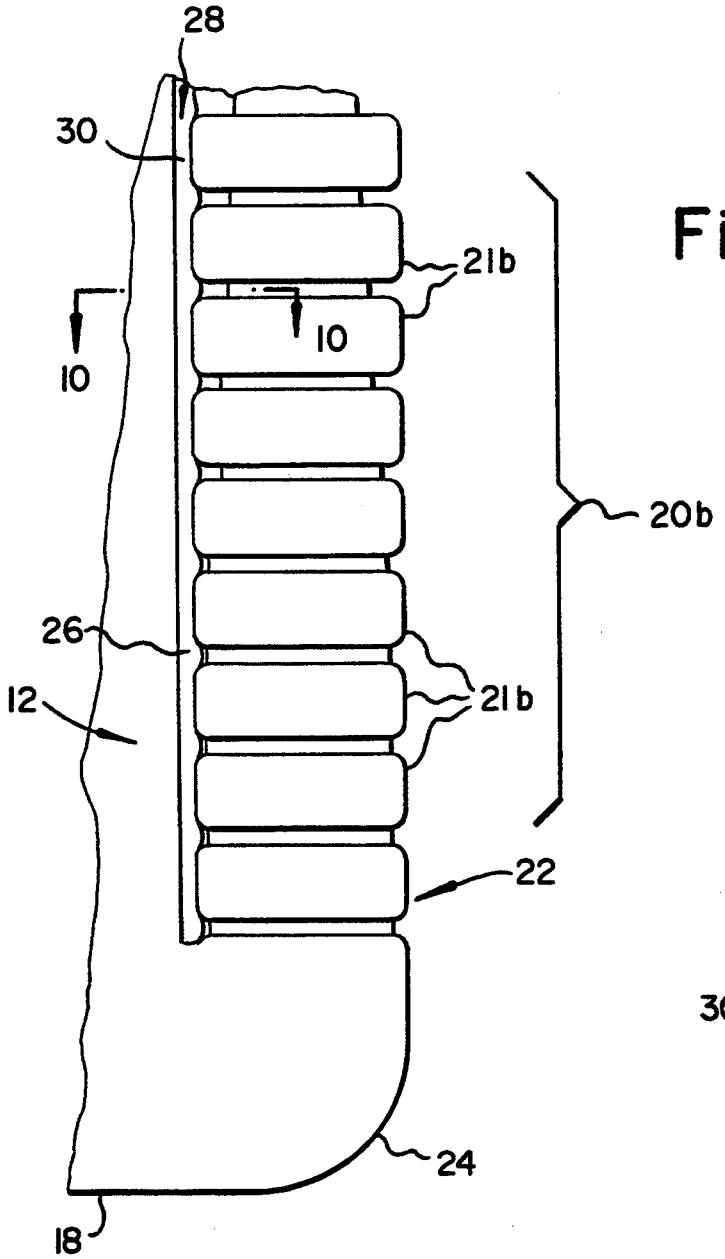
Fig. 9
Fig. 10
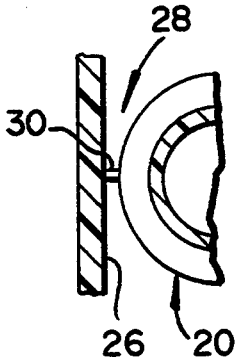
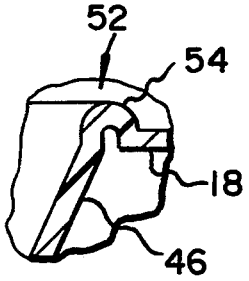
Fig. 12

BEVERAGE CONTAINER

RELATED APPLICATION

This application is a continuation-in-part of U.S. application No. 07/776,444 filed Oct. 17, 1991, now abandoned, which is hereby incorporated by reference.

FIELD OF THE INVENTION

The present invention relates generally to beverage containers, and more particularly to a one-piece or unitary beverage container with an integral straw.

BACKGROUND OF THE INVENTION

Many different beverages are provided in various containers. Of particular use by small children are small beverage containers which are accessed by a straw. Typically, the straw is removably attached to the outside of the container and is separately wrapped. Thus, the straw can be lost making the beverage hard to consume. In addition, the loose straw and wrapper for the straw are potential problems with small children who might accidentally try to swallow them. These loose items are also a trash nuisance as they tend to be dropped. Further, many of these small beverage containers are made from multi-ply laminates which include paper, foil and plastic and are therefore not easily recyclable.

A beverage container made of a synthetic resin and having a sipping tube or Straw connected to the container bottom is disclosed in U.S. Pat. No. 4,982,854 (Ichimiya). A middle portion of the sipping tube is provided with a flexional bellows and the sipping tube is fitted into a longitudinal groove formed on the container body.

Other patents have also disclosed various integral sipping tubes or straws. Among these are the following U.S. Pat. No. 4,607,755 (Andreozzi), U.S. Pat. No. 4,573,631 (Reeves), U.S. Pat. No. 4,830,204 (Lin), U.S. Pat. No. 5,054,631 (Robbins), and U.S. Pat. No. 5,078,286 (Hashimoto). Other containers of general interest including various straw mounting means are shown in the following U.S. Pat. No. 5,005,717 (Oilar), U.S. Pat. No. 3,332,567 (Pugh, St.), U.S. Pat. No. 4,669,608 (Thompson), and U.S. Pat. No. 4,712,702 (Ayabe et al.).

SUMMARY OF THE INVENTION

In accordance with the present invention, a unitary beverage container is provided which includes a main body defining a container volume in which a beverage is contained. The main body includes a top and a bottom, and attached to the main body is a flexible straw. The flexible straw includes a proximal end with which the straw is fluidly connected to the container volume adjacent the bottom of the main body. The flexible straw also includes a distal end formed as a mouthpiece having an aperture therein which is located adjacent the top of the main body. An attaching means is then provided for removably attaching the mouthpiece to the top of main body and for closing the aperture of the distal end of the flexible straw.

According to a preferred embodiment of the invention, the attaching means includes a hollow chamber attached to the top and a short hollow bridge extending from the distal end of the flexible straw and about the aperture to the hollow chamber. This hollow bridge is broken during removal of the distal end of the flexible straw from the top whereby the aperture of the flexible straw is uncovered prior to use. In addition, the hollow chamber includes a solid connection to the top of the container such that the hollow chamber is in fluid communication with the container volume only through the flexible straw. Further, the hollow bridge includes a weakening thereof which makes the hollow bridge easily broken thereat by twisting of the distal end. This weakening of the hollow bridge is preferably a V-shaped notch circumferentially thereabout and radially directed toward a central longitudinal axis of the hollow bridge.

In the preferred embodiment, the flexible straw is formed of a plurality of integral segments. Each integral segment is considered to (arbitrarily) comprise: an inner band, an outer band, an upper disk which connects the inner and outer bands together, and a lower disk which connects the outer band to the inner band of a preceding integral segment. With this construction, the disks form bending diaphragms to allow for the straw to bend as desired. In addition, the flexible straw extends along a side of the main body and along the top, so that the straw includes a curved section adjacent the junction between the side and the top. The inner and outer bands of the segments of this curved section are wedge shaped in a lateral and radial cross section of the curved section. The flexible straw is connected to the container volume adjacent the bottom. The inner bands of the portion of the flexible straw adjacent the proximal end have outside dimensions which decrease with the distance of the inner bands from the bottom. Other than at this bottom portion, the ratio of outside dimensions of the inner band to the outer band for a majority of the flexible straw is about 0.50 to 0.60, and most preferably about 0.55 to best provide for the bending diaphragm action of the disks. A second attaching means is also preferably provided to attach the flexible straw along the side of the main body.

The distal end of the flexible straw preferably includes a hollow, flanged or flared mouthpiece having a top wing and an opposed bottom wing. These wings extend vertically from a longitudinal axis of an adjacent portion of the flexible straw and are used to twist the distal end so as to break the hollow bridge easily. With this configuration, the top of the main body includes a concavity in which the bottom wing is received.

To effect filling of the beverage container, a filling tube or aperture may be provided which after filling may be crimped, sealed or otherwise closed off. After closure of a filling tube, excess material may be removed and, as shown in U.S. Pat. No. 5,078,286, hereby incorporated by reference, and as more particularly described hereinafter, the filling tube may be inverted into the main body of the container in order to provide a bottom surface free of projections. Another filling technique is as shown and described in the above-mentioned U.S. Pat. No. 4,982,854, hereby incorporated by reference, wherein a flanged filling aperture recessed within the bottom surface is sealed with an adhesive film after filling.

It is an object of the present invention to provide a one-piece beverage container which does not have any loose parts even after opening which can become lost or accidentally ingested or swallowed by the user or others.

It is also an object of the present invention to provide a one-piece beverage container which is easy to make, fill, and use.

It is a further object of the present invention to provide a one-piece beverage container which stands up readily and which is easy to package together with other such beverage containers.

It is a still further object of the present invention to provide a beverage container which does not spill easily.

Another object of the present invention is to provide a beverage container and associated parts which are strong and which will not easily develop leaks.

Other features and advantages of the present invention are stated in or apparent from a detailed description of a presently preferred embodiment of the invention found hereinbelow.

BRIEF DESCRIPTION OF THE DRAWINGS

FIG. 4 is an elevation view of the beverage container depicted in FIG. 1 which has been rotated 135°, and showing a cutaway of a filling tube after filling and being pushed inside as well as in phantom prior to filling.

FIG. 5 is orthogonal elevation view of the filling tube depicted in FIG. 4.

FIG. 9 is an elevation view of the corner of the beverage container where the straw is connected.

FIG. 10 is a cross-sectional plan view of the straw and adjacent main body portion taken along the line 10—10 in FIG. 9.

FIG. 11' is an enlarged sectional view of a portion of the bridge depicted in FIG. 11 indicated by the dashed circle 11'.

FIG. 12 is a cross-sectional elevation view of a portion of the bottom of the beverage container depicted in FIG. 4 indicated by the dashed circle 12.

DETAILED DESCRIPTION OF THE PREFERRED EMBODIMENTS

Figure 3:
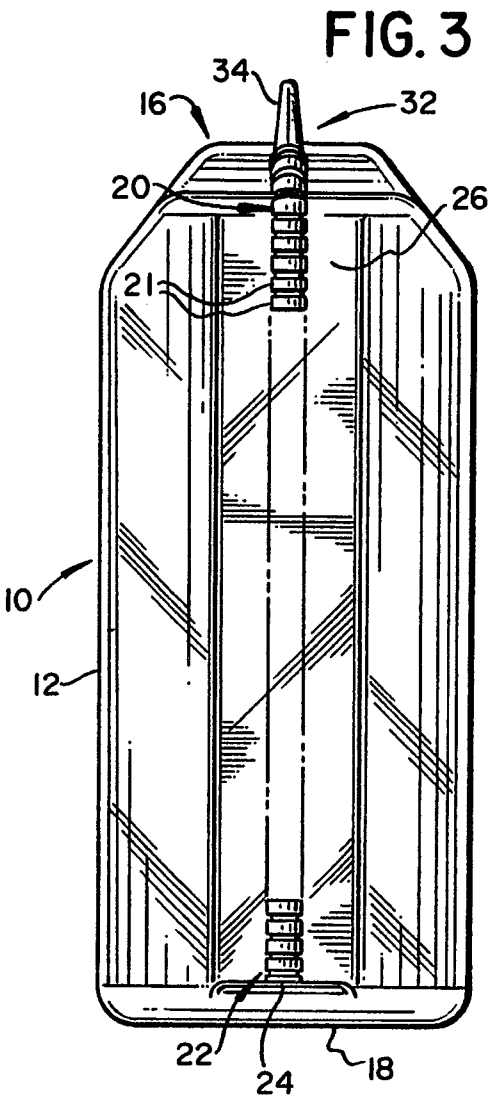
FIG. 3 is an elevation view of the filled beverage container depicted in FIG. 1 which has been rotated 45°.
Figure 2:
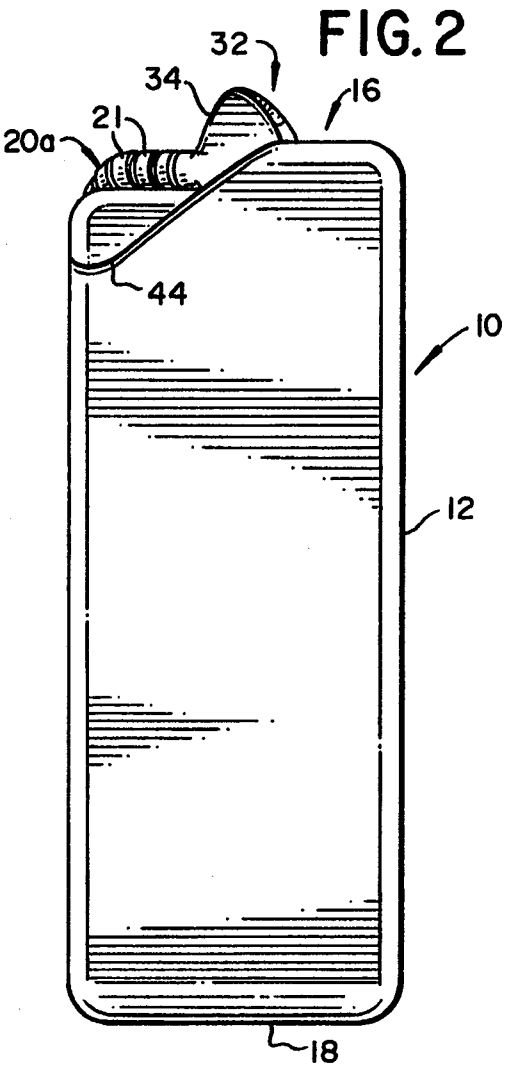
FIG. 2 is a rear elevation view of the filled beverage container depicted in FIG. 1.
Figure 1:
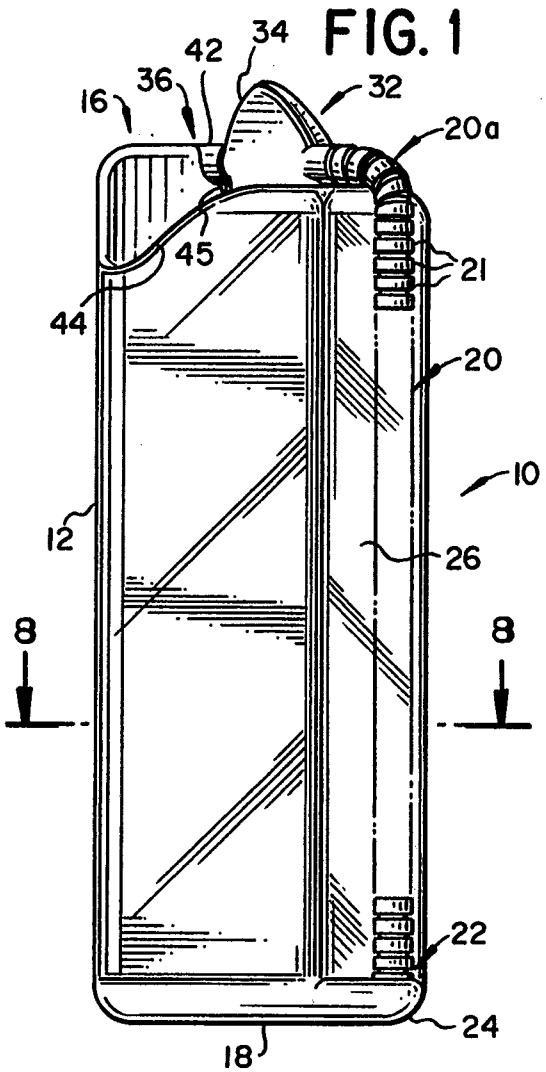
FIG. 1 is a front elevation view of a filled beverage container according to the present invention.

With reference now to the drawings in which like numeral represent like elements throughout the views, a beverage container 10 is depicted in FIGS. 1–4 and 6–8. Beverage container 10 is designed to be blow molded from a synthetic resin or plastic such as low density or high density polyethylene, as a unitary or one-piece container formed in a single operation. Beverage container 10 includes a main body 12 which is rectangularly shaped with rounded corners in plan view and which defines a container volume 14 in which a beverage is contained. Typically, such beverages are fruit juices, fruit-flavored drinks or the like. With such beverages, the material of beverage container 10 is usually translucent so that the liquid level can be seen, and the material is colored the same or similar to the color of the beverage contained. In addition, suitable indicia or the like can be provided on the walls of main body 12 as part of the blow molding process if desired. Main body 12 has a top 16 particularly shaped as described subsequently and a bottom 18 which is peripherally flat and somewhat recessed inside of the periphery so that beverage container 10 stands upright easily in normal use.

In order to access the beverage in volume 14 of main body 12, an integral sipping tube or straw 20 is provided which is formed to be easily bendable (as discussed in detail subsequently). As shown in greater detail in FIG. 9, straw 20 has a proximal end 22 which is integrally formed at a bottom corner 24 of main body 12. Straw 20 extends upwardly along a bevel surface 26 of main body 12 provided above corner 24 and between the two adjacent sides. As will be appreciated from FIG. 8, bevel surface 26 is sized so that straw 20 stays inside of the silhouette of main body 12 when viewed from the bottom.

Straw 20 is removably attached to bevel surface 26 by an attaching means 28, which in this preferred embodiment is simply very thin connecting pieces forming an essentially continuous strip 30 between the outer portions of straw 20 and bevel surface 26 as shown best in FIG. 10. Preferably, these connecting pieces of strip 30 are simply formed in the blow molding process and are so thin as to be easily broken by the user when it is desired to detach all but proximal end 22 of straw 20 from main body 12.

Figure 11:
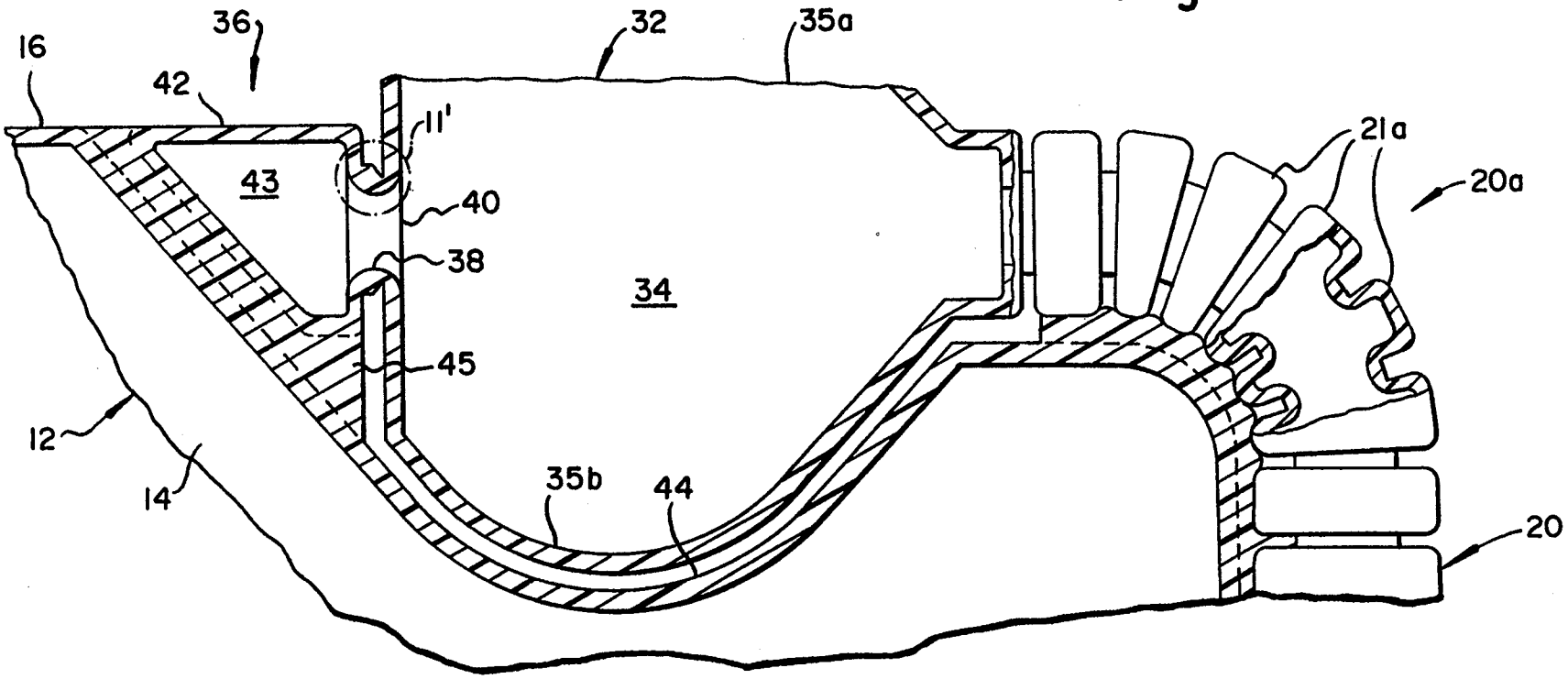
FIG. 11 is a cross-sectional elevation view of the top of the beverage container taken along the line 11—11 in FIG. 6.
Figure 11A:
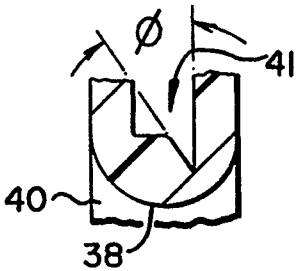

Straw 20 also includes a distal end 32 which is shaped into a mouthpiece 34. Mouthpiece 34 may be hollow and planar shaped as shown in FIG. 11 with an upper wing **35*a* (only part of which is shown) and a lower wing 35*b*. This configuration is designed to be easily retained in the mouth of a user, particularly young children. In addition, mouthpiece 34 is provided with wings 35*a* and 35*b* so that wings 35*a* and 35*b* can serve as a fulcrum or twisting handle. By use of such a fulcrum, mouthpiece 34 is easily detached from an attaching means 36 by which mouthpiece 34 is attached to top 16 of main body 12. It will be appreciated that mouthpiece 34 has been depicted in a preferred shape, but that mouthpiece 34 could be provided in a variety of shapes consistent with its use as a fulcrum. Mouthpiece 34 could also be made smaller so long as mouthpiece 34** is provided with sufficient surface area to serve as a fulcrum, and particularly the necessary finger gripping surface area for a thumb and forefinger.

Mouthpiece 34 with wings **35*a* and 35*b* is depicted as hollow and planar in a vertical plane, which is easy to provide as mouthpiece 34 (and the remainder of beverage container 10) is blow molded. This hollowness results in a small amount of air which is drawn into the mouth each time that the user sucks on straw 20. Thus, if desired, mouthpiece 34 could be made less hollow or even solid with just a tubular conduit therethrough. However, a hollow mouthpiece 34 is nonetheless preferred as such a configuration is more comfortable in the mouth. In addition, by making mouthpiece 34 hollow, this hollowness and overall planar shape also contribute to the stiffness of mouthpiece 34 necessary for wings 35***a* and 35*b* of mouthpiece 34 to serve as a fulcrum. Further, the existence of the hollow volume within mouthpiece 34 will reduce spillage from the container as the container is being opened and from the opened container in the event the container is knocked over.

As shown best in FIG. 11, attaching means 36 includes a short hollow bridge 38 extending from an aperture 40 provided in mouthpiece 34 to a connecting piece 42. The configuration of hollow bridge 38 is shown in greater detail in FIG. 11'. Thus, it will be appreciated that hollow bridge 38 is formed with a V-shaped notch 41 circumferentially thereabout which is radially directed toward a central longitudinal axis of hollow bridge 38 (and mouthpiece 34). Preferably, notch 41 is formed by an angle $\phi$ from vertical of about 30°. V-shaped notch 41 provides a localized weakening of hollow bridge 38 which is easily broken by twisting of mouthpiece 34. This V-shaped notch 41 or other thinned portion is easily formed in the molding process as the material flows about the mold piece.

The size of aperture 40 is not critical with respect to the sucking of the beverage from main body, although it obviously must be sufficient for a ready passage of a sufficient amount of the beverage when mouthpiece 34 is sucked on. However, the size of aperture 40 is important insofar as the larger the size, the greater the force which will be required to severe hollow bridge 38. Thus, a compromise is necessary for these competing objectives, and in beverage container 10 aperture 40 is preferably about 2 to 4 mm.

Connecting piece 42 of attaching means 36 is comprised of a hollow chamber 43 securely attached to a concavity or recess 44 provided in top 16 of main body 12 by a solid connection in the form of a connecting wall 45. Hollow chamber 43 is hollow in order to form aperture 40 in mouthpiece 34 during the blow molding process as beverage container 10 is formed. In particular, during the blow molding process, aperture 40 is formed as air passes through aperture 40 in order to subsequently form hollow chamber 43 in connecting piece 42. Hollow chamber 43 is otherwise not in fluid communication with main body 12. Were connecting piece 42 not to include a hollow portion, the material forming connecting piece 42 would simply build up as a solid and aperture 40 would not be formed as desired.

It will also be appreciated that it is important for hollow chamber 43 not to be in fluid communication with main body 12 except through straw 20. One reason is that if hollow chamber 43 was in fluid communication with main body 12, after mouthpiece 34 was removed, hollow chamber 43 would be a source of leakage from main chamber 12 in the event the container is knocked over or excessively squeezed during or after opening.

Another reason for not having hollow chamber 43 in fluid communication with main body 12 other than through straw 20 is that leakage through straw 20 upon opening and in use is actually reduced by this construction. This reduction of leakage in use is due to the fact that the beverage in main body 12 must be withdrawn by sucking on mouthpiece 34. This suction creates a negative pressure within main body 12. Consequently, when the user lets go of mouthpiece 34 or otherwise opens aperture 40 to atmosphere a residual negative pressure in main body 12 results in the liquid in straw 20 being drawn back toward main body 12. Typically, about half of the distal portion of straw 20 is then not filled with the beverage, and this is true even though the beverage height in main body 12 may be higher than that in straw 20. Thus, even if beverage container 10 falls over or is accidentally place on its side, due to the small size of aperture 40 in mouthpiece 34 and the lack of any other path for air to get into main body 12, as well as the absence of any beverage near mouthpiece 34, there is not likely to be any leakage of the beverage from beverage container 10.

Figure 6:
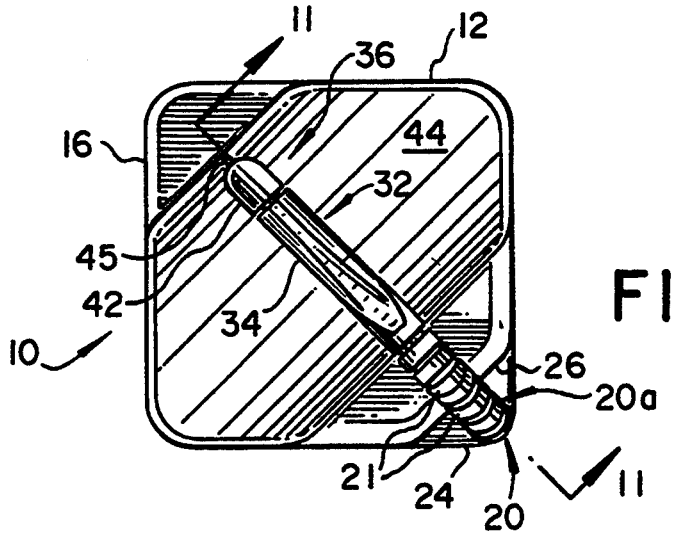
FIG. 6 is a top plan view of the beverage container depicted in FIG. 1.
Figure 7:
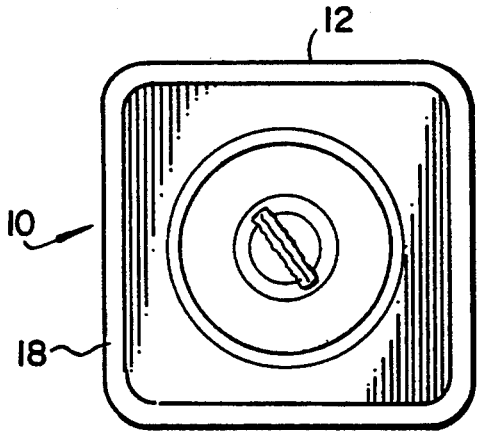
FIG. 7 is a bottom plan view of the beverage container depicted in FIG. 1.
Figure 8:
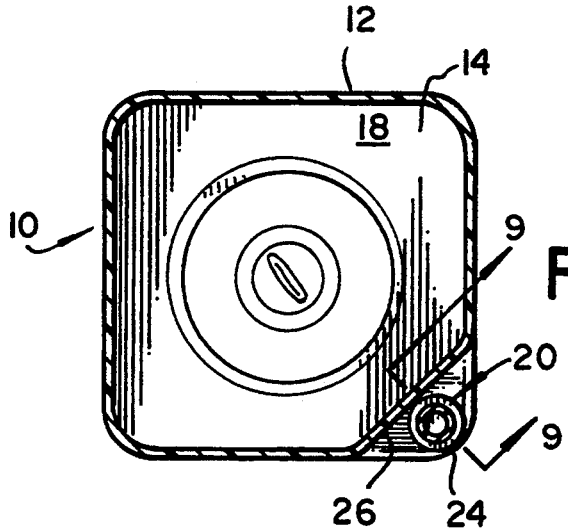
FIG. 8 is a cross-sectional view of the beverage container depicted in FIG. 1 and taken along the line 8—8.

As best shown in FIGS. 4 and 6, concavity 44 provided in top 16 of main body 12 extends along the entire corner-to-corner distance of top 16, and the shape of concavity 44 matches the profile of wing 35*b* of mouthpiece 34. It should be appreciated that top 16 of main body 12 is reduced in height at the side adjacent to straw 20 so that the height of top 16 at this position and the height of straw 20 (together with the minimal height of the connecting pieces of strip 30) together equal the height of the remainder of top 16. Thus, straw 20 is also contained in the profile of top 16 as shown in FIG. 3.

As mentioned above, mouthpiece 34 is easily detached from connection piece 42 by breaking bridge 38 at notch 41. This is easily done by twisting mouthpiece 34 about its longitudinal axis (which is shared with the adjacent portion of straw 20), typically by placing a thumb on one side of wing 35*a* and a forefinger on an opposite side of wing 35*b*. Twisting by applying opposite forces to wings 35*a* and 35*b* causes bridge 38 to nonelasticly deform and break at notch 41 so that mouthpiece 34 can be lifted out of concavity 44. At the same time that mouthpiece 34 is lifted, adjacent connecting pieces of strip 30 are easily severed. The shape, size and orientation of wing or level elements, as well as the number of wing or lever elements, may be varied.

Figure 13:
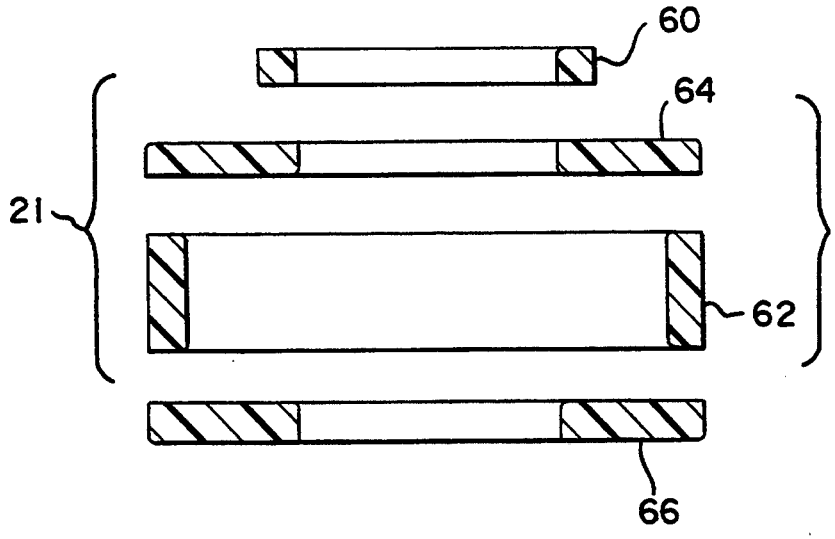
FIG. 13 is a schematic exploded cross-sectional elevation view of a segment of the flexible straw.

Straw 20, as shown, is comprised of a plurality of interconnected bellows-like segments 21. The precise place where the repeating segments of straw 20 should be considered to stop and start is arbitrary, and has been selected as depicted and described simply for clarity. As shown best in FIG. 13 and according to one embodiment of this invention, each segment 21 is considered to be composed of a series of integrally connected elements which are shown separated in FIG. 13 for clarity. Thus, the elements of each segment 21 are an inner band 60, an outer band 62, an upper disk 64 which connects inner band 60 to outer band 62, and a lower disk 66 which connects outer band 62 to an inner band 60 of a preceding segment 21 (not shown).

Figure 14:
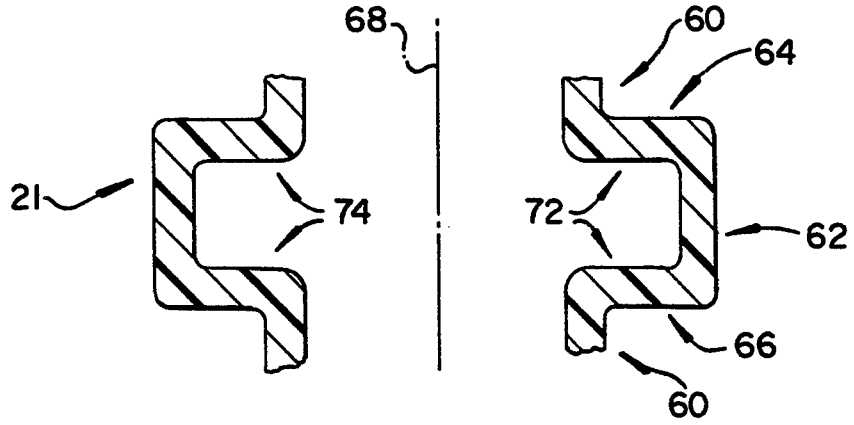
FIG. 14 is a schematic sectional view of the segment depicted in FIG. 13 when the straw is straight.

The precise configuration of segments 21 has been particularly designed to allow straw 20 to bend easily and without developing leaks. With reference to FIG. 14, segment 21 is depicted with the elements thereof oriented as they would be when straw 20 is straight as shown by center line 68. This configuration is simply what segment 21 shown in FIG. 13 looks like when the elements are integrally connected.

Figure 15:
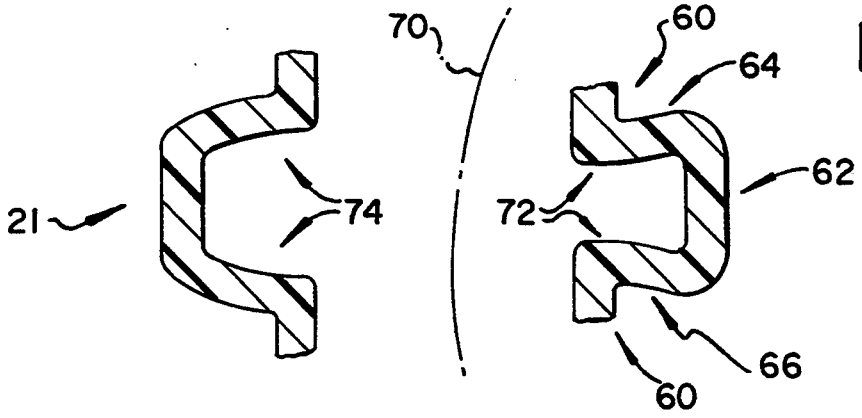
FIG. 15 is a schematic sectional view of the segment depicted in FIG. 13 when the straw is bent to a curved position.

As shown in FIG. 15, the elements of segment 21 undergo some elastic bending when straw 20 is bent or curved as indicated by curved center line 70. In particular, it will be appreciated that straw 20 is permitted to easily curve by the action of disks 64 and 66 which act as bending diaphragms. Thus, on the inside of the curve of straw 20, interior portions 72 of disks 64 and 66 bend toward one another and are slightly curved as shown; while on the outside of the curve of straw 20, interior portions 74 of disks 64 and 66 bend away from one another and are slightly curved in the opposite direction as shown. This bending diaphragm action of disks 64 and 66 is best seen by comparing FIGS. 14 and 15. Obviously, there is a smooth transition for each disk 64 and 66 between interior portions 72 and 74, as these portions have been depicted to show the extreme positions of disks 64 and 66 which most clearly show how bending is achieved with straw 20.

The bending diaphragm action of disks 64 and 66 is achieved by making segments 21 of a configuration such that disks 64 and 66 are capable of the movement noted above. This movement is allowed by the material of segments 21 as well as the specific geometry. In order to achieve a suitable bending action, some trial and error testing is necessary with any given material and configuration of segments. However, it has been found that the ratio of the outside diameter of inner band 60 to the outside diameter of outer band 62 is an important consideration in achieving a suitable bending action. This ratio has been determined to preferably fall within the range of about 0.50 to 0.60, and most preferably is about 0.55.

In addition, it has also been found that these segments 21 should be from 1.3 to 5.5 mm. in length over the vertical section of straw 20. Such a dimension provides straw 20 with sufficient flexibility to facilitate use by the consumer while maintaining sufficient rigidity to enable straw 20 to remain in an upright position after having been detached from both attaching means 30 and bevel surface 26 (as shown in phantom in FIG. 4). Preferably, segments 21 are about 2.2 to 3.2 mm. in height, and typically about 2.7 to 3.0 mm. in height.

Additionally, as shown in the drawings, segments 21*a* should possess a generally triangular or wedge shaped side profile (or lateral and radial cross-sectional profile as shown in the broken away portion of FIG. 11) at curved straw portion 20*a* where straw 20 forms the approximately 90° bend at the upper corner of main body 12. As shown best in FIG. 11, this wedge shape applies both to inner bands 60 as well as outer bands 62. It should also be appreciated that because segments 21*a* are otherwise configured similar to segments 21, curved straw portion 20*a* is bendable in the same manner as the rest of straw 20. Thus, curved straw portion 20*a* can be substantially straightened by the user if it is desired for straw 20 to extend more or less straight as shown in chained lines in FIG. 4.

While straw 20 is designed to be generally easily bendable, this is not true of stiffened straw portion 20*b* adjacent proximal end 22 of straw 20. Thus, as shown best in FIG. 9, the outer diameters of inner bands 60 of segments 21 are progressively smaller in an orderly manner to a minimum with increasing distance or height from proximal end 22. This causes segments 21*b* of stiffened straw portion 20*b* to become increasingly stiff the closer segment 21*b* is to proximal end 22, and thus stronger in order to withstand forces which would tend to concentrate thereat and pull stiffened straw portion 20*b* from corner 24 of main body 12.

In order to fill beverage container 10, beverage container 10 may be initially provided with a filling tube 46 which initially extends from bottom 18 of main body 12 as shown in phantom in FIG. 4 and in FIG. 5. Filling tube 46 is cylindrically shaped, and due to the blow molding process of formation includes an apertured tip 48. Before the filling operation, tip 48 is cut off, such as at line 50, from the remainder of filling tube 46 to form a filling opening. In the filling operation, it will be appreciated that beverage container 10 is inverted from the orientation shown in the figures so that the beverage is easily introduced through filling tube 46 and retained in volume 14 by gravity.

After filling, the end of filling tube 46 is heat sealed or crimped closed. Then, filling tube 46 is pushed or slammed by a plunger or the like so as to be partially inverted and thus located in the interior of main body 12, as shown best in FIG. 4. This is done while filling tube 46 is warm (at least because the beverage is hot) so that there is not much resistance to this movement. While there is some increase in pressure in main body 12 caused by this inversion, this increase is more or less matched by a decrease in pressure as the hot beverage cools.

This partial inversion is facilitated by the presence of inversion facilitating means 52 and 53. As best shown in FIG. 12, inversion facilitating means 52 is preferably a semicircular indentation 54 provided about filling tube 46 in bottom 18 of main body 12 which is readily and preferentially deformed as filling tube 46 is moved into the interior of main body 12. As best shown in FIG. 4, inversion facilitating means 53 is a sharply angled connecting portion 55 along filling tube 46 between the frustoconical portion which is inverted and the straight portion which is sealed.

A benefit of filling inverted beverage container 10 through a bottom filling structure is that, as a result of lack of communication between hollow chamber 43 and main chamber 12, liquid does not flow into the straw so long as the fluid level does not rise to the proximal end 22 of straw 20. When container 10 is returned to its upright orientation air contained in straw 20 will prevent fluid from rising up in straw 20. Thus, upon the initial opening of container 10, the likelihood of liquid being forced from distal end 32 of straw 20 is much reduced as both the empty volume of straw 20 and the empty volume within mouthpiece 34 would have to be overcome.

After opening of container 10 the fluid level in the straw remains depressed as a result of the sub-atmospheric pressure present in the top headspace of main chamber 12. Low headspace pressure results from hot-filling of the liquid so that after sealing and cooling of container 10, a partial vacuum is formed. When a consumer sucks liquid from mouthpiece 34 and then releases mouthpiece 34 to the atmosphere, external pressure will act to depress the liquid level in straw 20. Thus it can be seen that as a result of the container structure and hot filling the inverted container through a bottom structure, spillage, which could result from excessive squeezing of container 10 or form accidental tipping of container 10, is greatly minimized.

In use, it will be initially appreciated that beverage container 10 is filled and sold to the consumer or user with a protective wrapping material (shrink wrap, plastic overlay, or the like) thereabout as well known by those of ordinary skill in the art. If desired, a number of beverage containers 10, such as six, can be bound together as a pack by the wrapping material. A cardboard sleeve may be positioned around such a pack inside of the wrapping material.

After removal from the wrapping material, the user simply twists mouthpiece 34. This is easily done due to the combined features of the flat shape of mouthpiece 34 with wings 35*a* and 35*b*, the concavity 44 provided, and the fact that wing 35*a* of mouthpiece 34 extends beyond straw 20. This twisting of mouthpiece 34 easily causes notch 41 of bridge 38 to break or shear apart. When this occurs, aperture 40 of mouthpiece 34 is exposed, and mouthpiece 34 can be lifted from concavity 44. As mouthpiece 34 is lifted from concavity 44, the connecting portions of strip 30 attaching the adjacent segment of straw 20 to top 16 are also easily broken or severed. Similarly, by continued pulling on straw 20, the remaining connecting portions of strip 30 along bevel surface 26 are severed so that straw 20 can be moved by the user to any convenient position, such as that shown in phantom in FIG. 4. In this position, the user simply sucks on mouthpiece 34 to drink the beverage in volume 14 of main body 12.

It should be appreciated that mouthpiece 34 is easily retained in the mouth of the user due to its flat shape, which is especially advantageous for young children. In addition, by making straw 20 flexible, the user can play with the straw which is also an attraction for young children. Further, it should be appreciated that there are no loose parts of beverage container 10 which could become lost or accidentally ingested or swallowed.

While the present invention has been described with respect to an exemplary embodiment thereof, it will be understood by those of ordinary skill in the art that variations and modifications can be effected within the scope and spirit of the invention.

What is claimed is:

1. A unitary, blow-molded beverage container comprising:

a main body defining a container volume in which a beverage is contained, said main body including a top and a bottom;

a flexible straw having a proximal end which is fluidly connected with the container volume adjacent said bottom of said main body and a distal end having an aperture therein which is located adjacent said top of said main body; and an attaching means for removable attaching said distal end of said flexible straw to said top of said main body and for closing said aperture of said distal end of said flexible straw, said attaching means including a hollow chamber attached to said top and a short hollow bridge extending from said distal end of said flexible straw and about said aperture to said hollow chamber, wherein said hollow chamber includes a solid connection to said top of said container such that said hollow chamber is in fluid communication with said container volume only through said flexible straw, whereby said hollow bridge is broken during removal of said distal end of said flexible straw from said top and said aperture of said flexible straw is uncovered prior to use, and whereby opening the container in this manner creates no loose parts.

2. A beverage container as claimed in claim 1 wherein said hollow bridge includes a V-shaped notch circumferentially thereabout and radially directed toward a central longitudinal axis of said hollow bridge which makes said hollow bridge easily broken thereat by twisting of said distal end.

3. A beverage container as claimed in claim 1 wherein said hollow bridge includes a weakening thereof which makes said hollow bridge easily broken thereat by twisting of said distal end.

4. A beverage container as claimed in claim 1 wherein said flexible straw is formed of a plurality of segments with each said segment comprising an inner band, an outer band.

5. A beverage container as claimed in claim 1 wherein said flexible straw extends along a side of said main body and along said top and includes a curved section adjacent the junction between said side and said top.

6. A beverage container as claimed in claim 1 wherein a stiffened portion of said flexible straw connects said straw to the container volume adjacent said bottom.

7. A beverage container as claimed in claim 4 wherein a ratio of outside dimensions of said inner band to said outer band of said flexible straw other than for said stiffened portion is about 0.50 to 0.60.

8. A beverage container as claimed in claim 7 wherein said ratio is about 0.55.

9. A beverage container as claimed in claim 1 wherein said distal end of said flexible straw includes a mouthpiece having a top wing and an opposed bottom wing which said wings extend vertically from a longitudinal axis of an adjacent portion of said flexible straw; and wherein said top of said main body includes a concavity in which said bottom wing is received.

10. A beverage container as claimed in claim 9 wherein said mouthpiece is hollow.

11. A beverage container as claimed in claim 4 wherein said distal end of said flexible straw includes a mouthpiece having a top wing which extends vertically from a longitudinal axis of an adjacent portion of said flexible straw.

12. A beverage container as claimed in claim 11 wherein a filling structure is contained in the bottom surface of the container, said filling structure designed to be utilized when the container is in an inverted orientation.

13. A beverage container as claimed in claim 12 wherein the proximal end of the straw is connected to the main body of the container at a .level which, when the container is filled in an inverted orientation, is above the level of the beverage such that beverage does not pass into the straw during filling.

14. The beverage container as described in claim 13 wherein the mouthpiece is hollow.

15. A beverage container as claimed in claim 1 wherein said distal end of said flexible straw includes a hollow mouthpiece.

* * * * *